US007537067B1

(12) United States Patent
Quisenberry

(10) Patent No.: US 7,537,067 B1
(45) Date of Patent: May 26, 2009

(54) ROTARY CLAW BIT

(76) Inventor: Quinton Q. Quisenberry, 408 Temple Brown Rd., Roseburg, OR (US) 97470

( * ) Notice: Subject to any disclaimer, the term of this patent is extended or adjusted under 35 U.S.C. 154(b) by 200 days.

(21) Appl. No.: 11/442,041

(22) Filed: May 26, 2006

Related U.S. Application Data

(60) Provisional application No. 60/721,356, filed on Sep. 27, 2005.

(51) Int. Cl.
*E21B 10/26* (2006.01)

(52) U.S. Cl. ..... 175/385; 175/421; 175/431; 175/432

(58) Field of Classification Search ..... 175/385, 175/397, 412, 413, 421, 431, 426, 428, 432, 175/393
See application file for complete search history.

(56) References Cited

U.S. PATENT DOCUMENTS 3,720,273 A 3/1973 McKenry et al.
3,821,993 A 7/1974 Kniff et al.
4,813,501 A * 3/1989 Mills et al. ..... 175/335
5,735,360 A * 4/1998 Engstrom ..... 175/391
5,829,539 A * 11/1998 Newton et al. ..... 175/393

OTHER PUBLICATIONS

Mills Machine Company, Inc., Rotary Claw Bits, www.millsmachine.com/pages/home, 2004, 2 pages.
Mills Machine Company, Inc., (No title), www.millsmachine.com/images, 2004, 1 page.

* cited by examiner

*Primary Examiner*—David J Bagnell
*Assistant Examiner*—Sean D Andrish
(74) *Attorney, Agent, or Firm*—Robert E. Howard

(57) ABSTRACT

A rotary claw bit for drilling. The rotary claw bit includes a base plate having multiple lobes, the lobes having upper surfaces located in the same plane and lower surfaces located in the same plane. A plurality of bullet tooth attachment blocks are attached to the upper surface of each of the lobes. A bullet tooth having a hardened tip is removably attached within each of the attachment blocks. A pilot bit extends upwardly from the center of the base plate, the pilot bit having a tip that is located above the hardened tips of said bullet teeth. A tapered neck is attached to the lower surface of the base plate and adapted to be connected to a drilling string.

16 Claims, 4 Drawing Sheets

Fig. 1
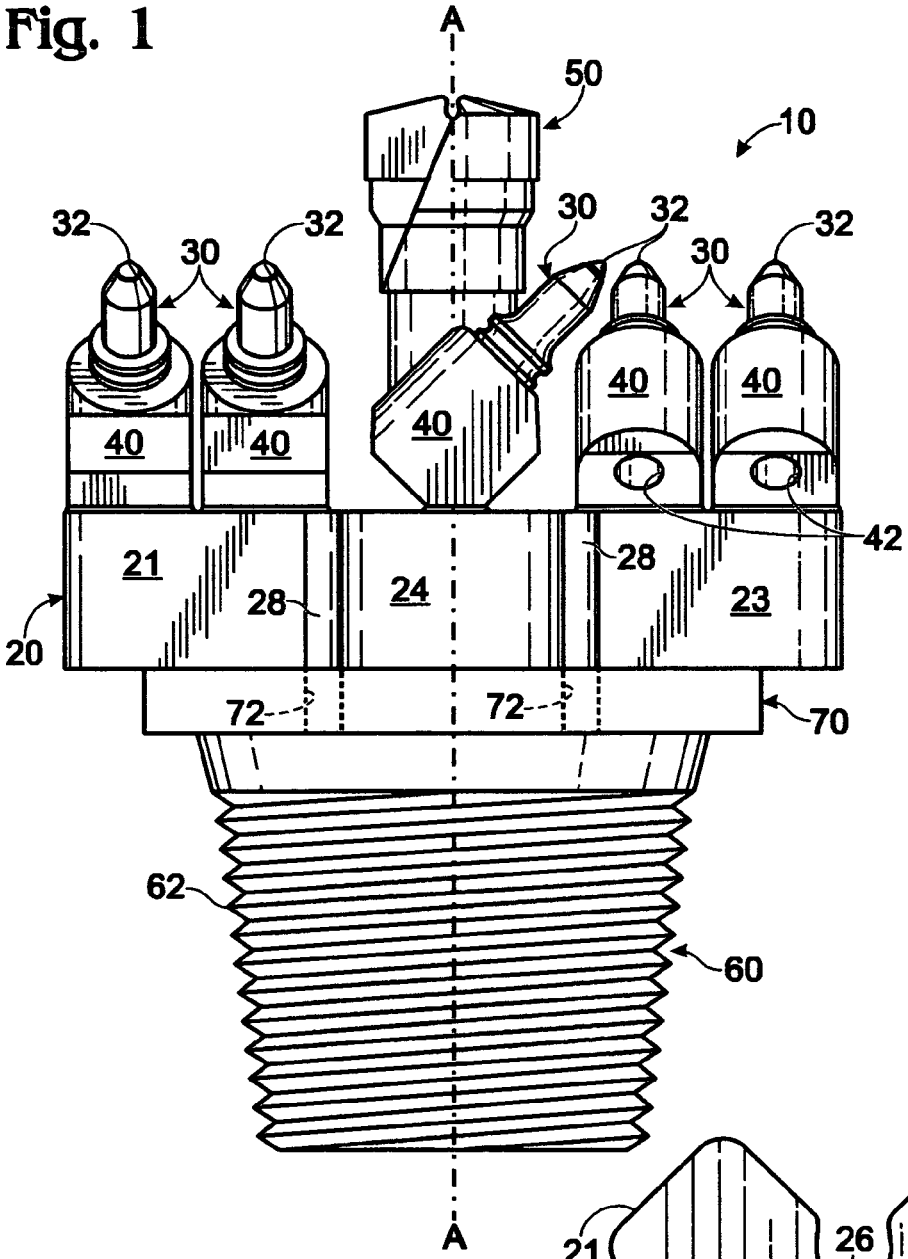
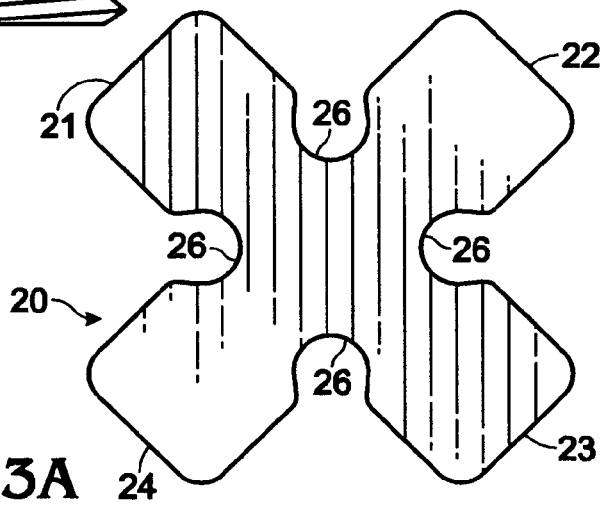
Fig. 3A

ROTARY CLAW BIT

CROSS-REFERENCE TO RELATED APPLICATIONS

This application claims the benefit of U.S. Provisional Application No. 60/721,356, filed Sep. 27, 2005.

BACKGROUND OF THE INVENTION

The present invention relates to a rotary claw bit adapted to be carried on the end of a drill string for drilling holes in the earth.

The prior art suggests a number of types of bits for drilling holes in the earth. Many of these devices are complex, difficult to make and repair, are very heavy, and/or have slow rates of penetration.

SUMMARY OF THE INVENTION

It is an object of the present invention to provide a rotary claw bit that is easy to make, lighter in weight, and provides improved rates of penetration.

The rotary claw bit of the present invention includes a base plate having multiple lobes, the lobes having upper surfaces located in the same plane and lower surfaces located in the same plane. A plurality of bullet tooth attachment blocks are attached to the upper surface of each of the lobes. A bullet tooth having a hardened tip is removably attached within each of the attachment blocks. A pilot bit extends upwardly from the center of the base plate, the pilot bit having a tip that is located above the hardened tips of said bullet teeth. A tapered neck is attached to the lower surface of the base plate. The rotary claw bit has an axis of rotation passing through the center of said base plate, the pilot bit and tapered neck each having a longitudinal axis located on the axis of rotation.

BRIEF DESCRIPTION OF THE DRAWINGS

FIG. 1 is a side elevational view of a first embodiment of the rotary claw bit of the present invention;

FIG. 3A is a top plan view of a four lobed base plate for the rotary claw bit;

DESCRIPTION OF PREFERRED EMBODIMENTS

Figure 2:
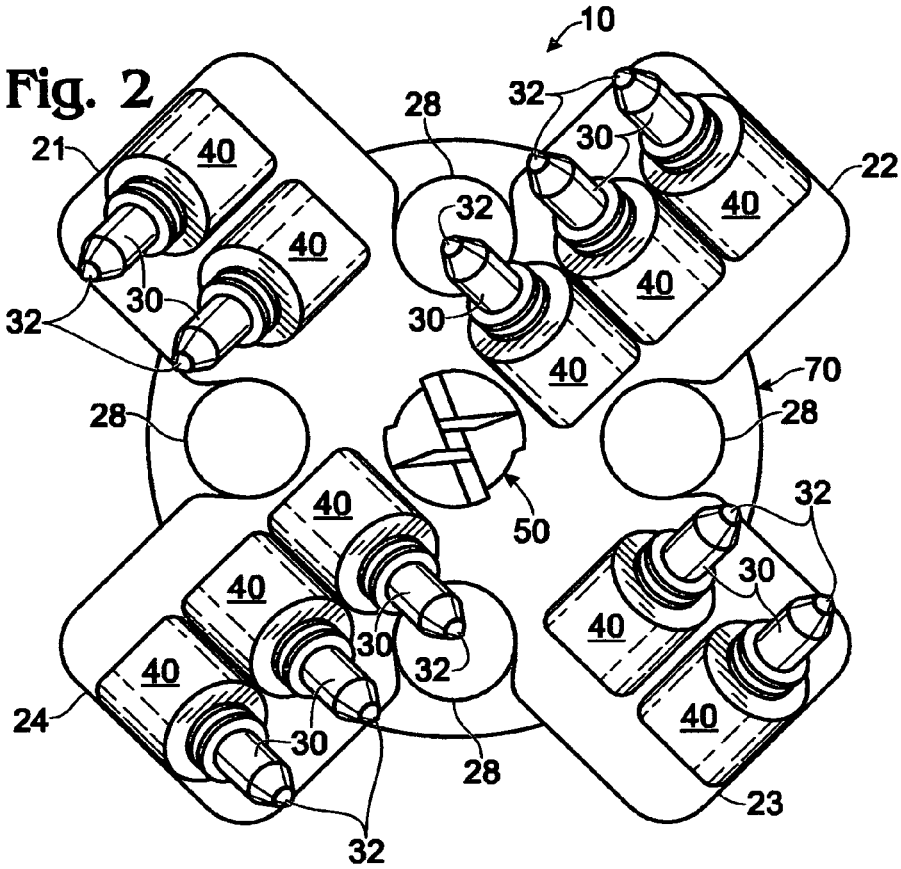
FIG. 2 is a top plan view of the first embodiment of the rotary claw bit.

The rotary claw bit 10 of the present invention includes lobed base plate 20, a plurality of bullet teeth 30 mounted in blocks 40, a pilot bit 50, a tapered neck 60, and neck attachment plate 70.

Lobed base plate 20 is shown in more detail in FIG. 3A. Lobed base plate 20 includes a plurality of lobes 21, 22, 23 and 24. Lobes 21-24 have substantially the same length as measured from the center of base plate 20. The upper surfaces of lobes 21-24 are located in the same plane, and the lower surfaces of lobes 21-24 are located in the same plane. A plurality of semi-circular channels 26 are formed at the intersection of adjacent lobes.

Figure 3B:
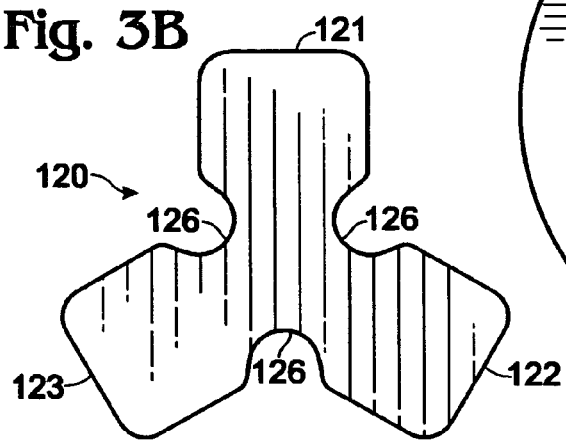
FIG. 3B is a top plan view of a three lobed base plate for the rotary claw bit.

Although four lobes are preferred, a three lobed base plate 120 may be used, as shown in FIG. 3B. Three lobed base plate 120 includes lobes 121, 122, and 123. Lobes 121-123 have substantially the same length as measured from the center of base plate 120. The upper surfaces of lobes 121-123 are located in the same plane, and the lower surfaces of lobes 121-123 are located in the same plane. A plurality of semi-circular channels 126 are formed at the intersection of adjacent lobes.

Figure 4:
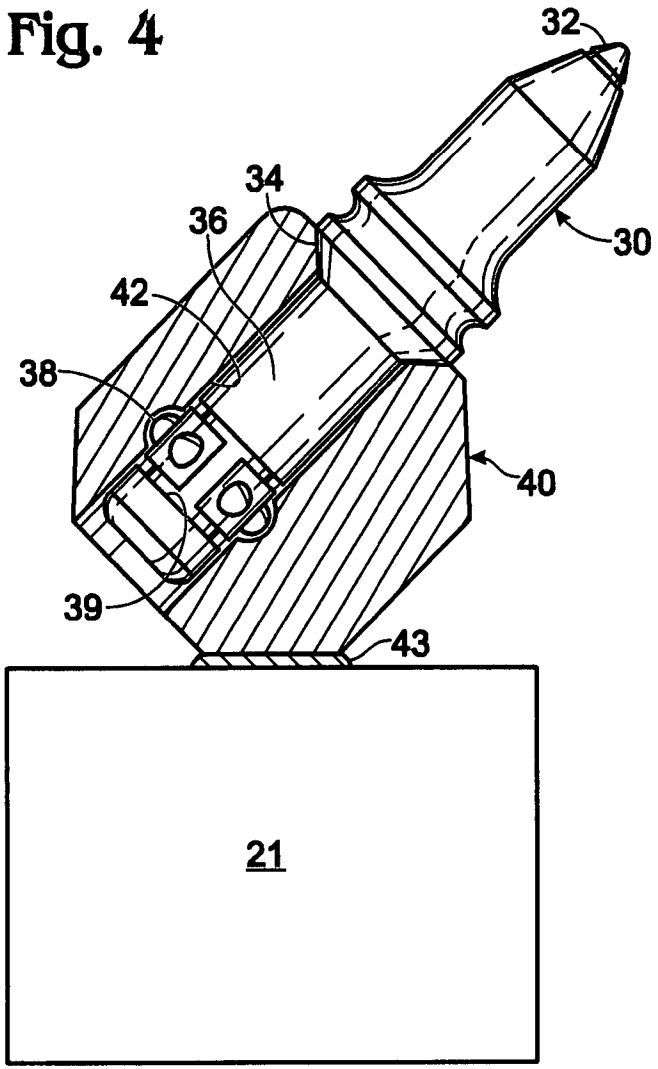
FIG. 4 is a side elevational view, partially in section, of the shank and associated bullet tooth shown mounted on the base plate.

As best seen in FIG. 4, tooth 30 has a hard, wear resistant tip 32 which can be made of a metal carbide, such as tungsten carbide. Block 40 and tooth 30 have interengaging thrust transmitting shoulders at 34. Shank 36 of tooth 30 is received within a bore 42 in block 40. Tooth 30 is releasably retained in block 40 by means of spring band 38 mounted in groove 39 in shank 36 of tooth 30. Block 40 is attached to the upper surface of lobed base plate 20 by any suitable means, such as by welding at 43. Tooth 30 is held by block 40 to provide that the longitudinal axis of tooth 30 is at an angle to the plane of the upper surface of base plates 20 or 120, preferably at an angle of about 45 degrees.

In a first embodiment of the present invention all of the blocks 40 are attached to lobed base plate 20 in the same plane, i.e., the plane passing through the upper surface of lobed base plate 20, and all extend to the same height above the upper surface of lobed base plate 20.

A first set of opposing lobes 21 and 23 have two blocks 40 located on each lobe, an inner block on each lobe being located adjacent pilot drill 50 and an outer block on each lobe being located adjacent the outer end thereof. The blocks on each lobe are spaced apart.

The second set of opposing lobes 22 and 24 have three blocks 40 located on each lobe, an inner block on each lobe being located adjacent pilot drill 50, an outer block on each lobe being located adjacent the outer end thereof, and an intermediate block on each lobe being located intermediate the inner and outer blocks. The blocks are spaced closely together.

The blocks 40 on all of the lobes 21-24 are positioned to hold teeth 30 facing in the direction of rotation of the rotary claw bit 10 during drilling. If the direction of rotation of the rotary claw bit 10 is counterclockwise, then teeth 30 will all face counterclockwise, as shown in FIG. 2.

Figure 7:
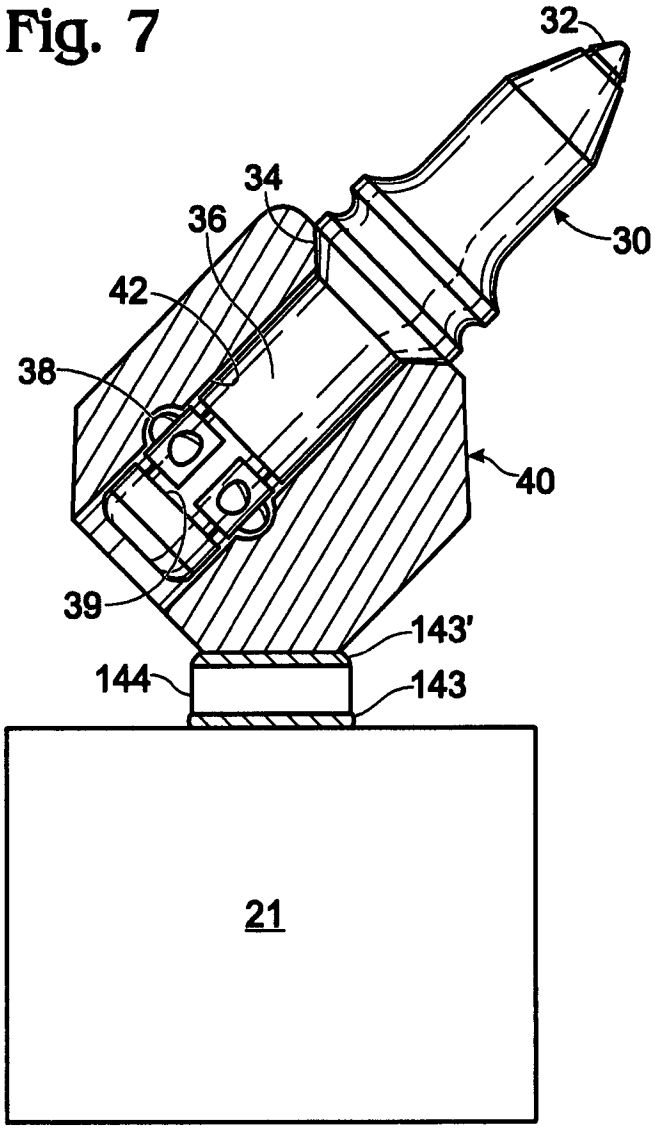
FIG. 7 is a side elevational view, partially in section, of the inner shank and associated bullet tooth of the second embodiment shown mounted on the base plate.
Figure 6:
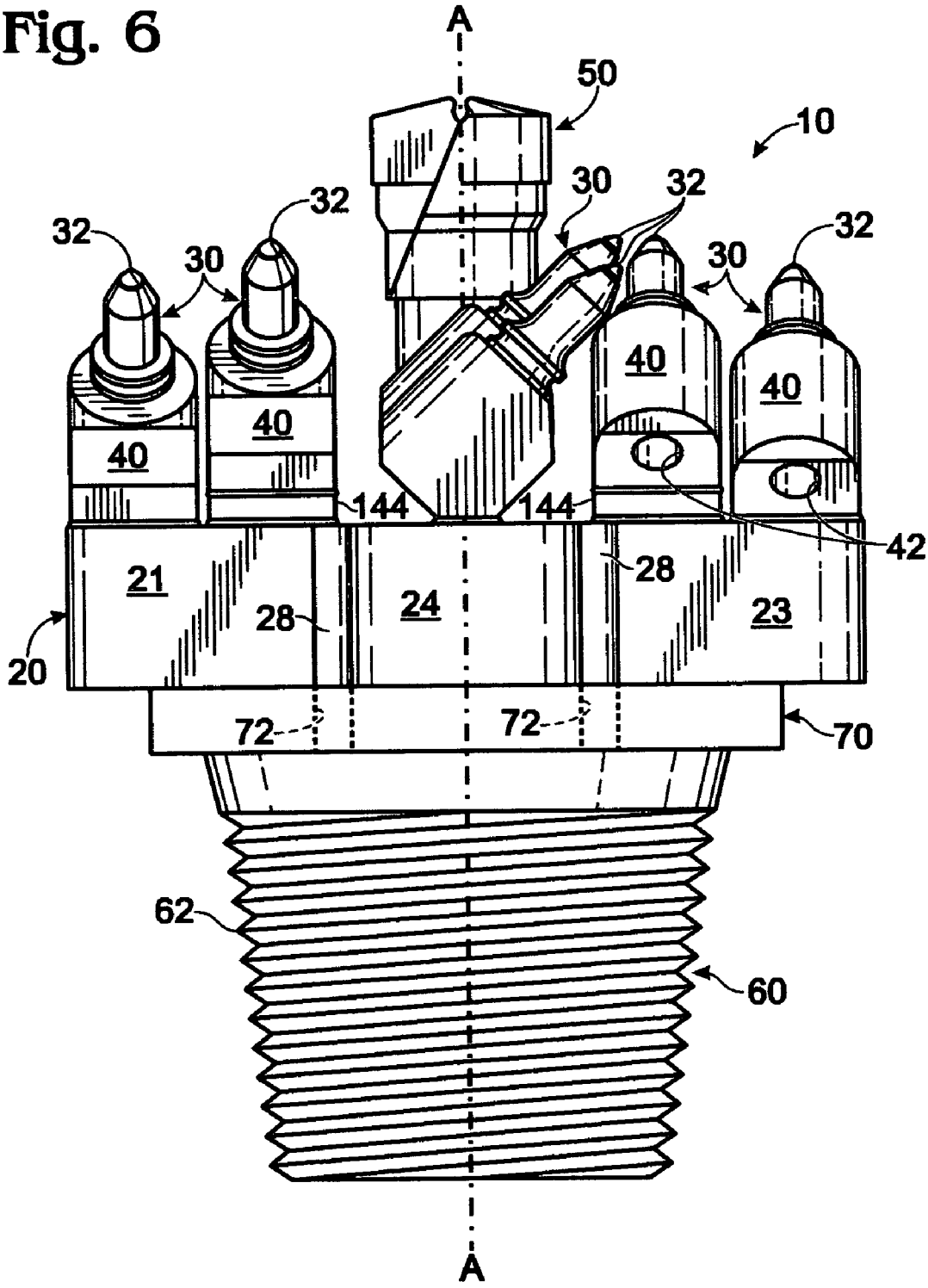
FIG. 6 is a side elevational view of a second embodiment of the rotary claw bit of the present invention.

In a second embodiment, as shown in FIGS. 6 and 7, the inner blocks 40 adjacent pilot bit 50 are elevated higher than the blocks 40 not adjacent pilot bit 50 by means of shim blocks 144 and weldments 143, 143'. In this embodiment, the pilot bit 50 extends the highest distance above the upper surface of lobed base plate 20, the teeth 30 held within those blocks 40 not adjacent the pilot bit 50 extend the shortest distance above the upper surface of lobed base plate 20, and those teeth 30 held with those blocks 40 adjacent pilot bit 50 extend above the upper surface of lobed base plate 20 a distance intermediate that of pilot bit 50 and those teeth 30 held within those blocks not adjacent pilot bit 50.

Teeth 30 and blocks 40 can be any compatible components available in the drilling marketplace. A suitable combination is a tooth sold by Kennametal Inc. as tool "C23", and a block sold by them as block "C20".

Pilot bit 50 can be any commercially available pilot bit, such as one designated as "CP18" sold by Kennametal Inc.

However, it is important that the pilot bit be elevated above teeth 30 to provide faster drilling rates. Some prior art devices generally have the pilot bit almost level with the teeth.

Figure 5:
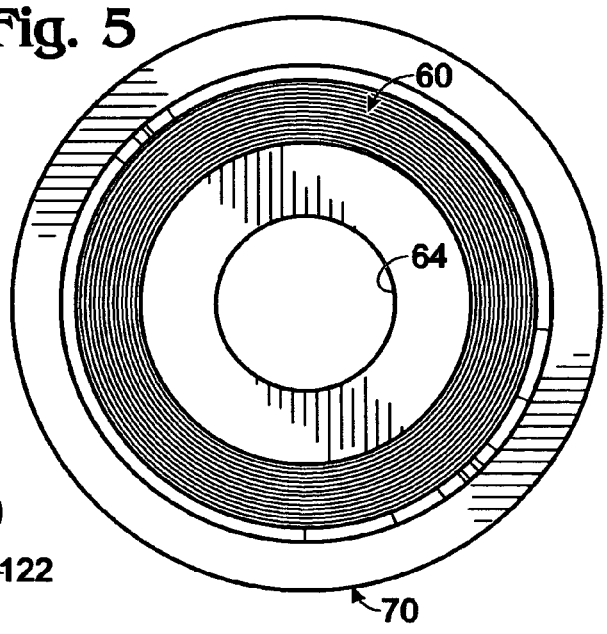
FIG. 5 is a bottom plan view of the tapered neck and neck attachment plate.

Tapered neck 60 is externally threaded with a plurality of threads 62 adapted to be threaded into a box-type sub of a drilling string (not shown) having a tapered, internally threaded female socket therein. As best seen in FIG. 5, tapered neck 60 defines a central, generally cylindrical passageway 64 which extends therethrough from one end to the other. The longitudinal axis of tapered neck 60 is in alignment with the longitudinal axis of pilot bit 50, and both lie along the axis of rotation A-A of rotary claw bit 20.

Neck attachment plate 70 is circular, and its center is located on the axis of rotation A-A. Neck attachment plate 70 is attached to the upper end of tapered neck 60 by any suitable means, such as welding. Neck attachment plate 70 has four cylindrical passageways 72 passing therethrough whose longitudinal axes and are in alignment with the longitudinal axes of pipes 28 of lobed base plate 20. During use of rotary claw bit 10 to drill a hole, cylindrical passageways 72 and pipes 28 are adapted to receive water lines passing through neck 60.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A rotary claw bit comprising:

a base plate having multiple lobes, said multiple lobes having upper surfaces located in the same plane and lower surfaces located in the same plane, each of said lobes having substantially parallel side walls and an outer end wall, said side walls of adjacent lobes being spaced apart at an angle to provide a space between said adjacent lobes;

a pilot bit extending downwardly from a center of said base plate;

semi-circular channels being formed at an intersection of adjacent lobes with cylindrical pipes positioned therein and attached thereto, each of said cylindrical pipes adapted to receive water therethrough;

a plurality of bullet tooth attachment blocks attached to the lower surface of each of said lobes, one bullet tooth attachment block being attached to the lower surface of each of said lobes adjacent said pilot bit and one bullet tooth attachment block attached to the lower surface of each of said lobes adjacent said outer end wall thereof;

a plurality of bullet teeth, each of said bullet teeth being removably attached within one of said attachment blocks, each of said bullet teeth having a hardened tip, each of said bullet teeth having a longitudinal axis that is at an angle to the plane of said lower surfaces of said lobes, the longitudinal axes of adjacent bullet teeth on each of said lobes being located substantially within the same plane and substantially parallel to each other, said pilot bit having a tip that is located below the hardened tips of said bullet teeth;

a tapered neck attached to an upper surface of said base plate and adapted to be connected to a drilling string;

said rotary claw bit having an axis of rotation about which it rotates in a counterclockwise or clockwise direction of rotation during use, said axis of rotation passing through the center of said base plate, said pilot bit and said tapered neck each having a longitudinal axis located on said axis of rotation.

2. The rotary claw bit of claim 1 wherein all of said bullet tooth attachment blocks are positioned to hold said bullet teeth facing in the direction of rotation of said rotary claw bit during use.

3. The rotary claw bit of claim 1 wherein said base plate has four lobes equidistantly spaced apart to thereby form first and second sets of opposing lobes.

4. The rotary claw bit of claim 3 wherein opposing lobes have the same number of bullet tooth attachment blocks attached thereto.

5. The rotary claw bit of claim 4 wherein said first set of opposing lobes has two bullet tooth attachment blocks attached thereto, and said second set of opposing lobes has three bullet tooth attachment blocks attached thereto.

6. The rotary claw bit of claim 4 wherein said bullet tooth attachment blocks are adapted to hold the tips of said bullet teeth substantially the same height below said lower surfaces of said lobes.

7. The rotary claw bit of claim 4 wherein each of said first and second set of opposing lobes has inner bullet tooth attachment blocks attached thereto adjacent said pilot bit and outer bullet tooth attachment blocks adjacent the outer ends of said lobes, the height of said tips of said bullet teeth below said lower surfaces of said lobes to which said bullet teeth are removably attached within said inner bullet tooth attachment blocks being intermediate the height of said pilot bit and the height of said bullet teeth removably attached within said outer bullet tooth attachment blocks.

8. The rotary claw bit of claim 1 wherein said longitudinal axis of said bullet teeth are at an angle of about 45 degrees to the plane of said lower surface of said base plate.

9. The rotary claw bit of claim 1 wherein said base plate has three lobes substantially equidistantly spaced apart.

10. The rotary claw bit of claim 1 wherein said tapered neck is attached at its lower end to a circular neck attachment plate, and said neck attachment plate is attached to the upper surface of said base plate.

11. The rotary claw bit of claim 1 wherein said tapered neck is attached to said base plate by means of a neck attachment plate which has a plurality of cylindrical passageways extending therethrough and each of said spaced cylindrical passageways has a longitudinal axis that is in alignment with the longitudinal axis of an adjacent one of said cylindrical pipes.

12. A rotary claw bit comprising:

a base plate having four lobes equidistantly spaced apart to thereby form first and second sets of opposing lobes, said lobes having upper surfaces located in the same plane and lower surfaces located in the same plane, each of said lobes having substantially parallel side walls and an outer end wall, said side walls of adjacent lobes being spaced apart at an angle of substantially 90 degrees to provide a space between said adjacent lobes;

a pilot bit extending downwardly from a center of said base plate;

semi-circular channels being formed at an intersection of adjacent lobes with cylindrical pipes positioned therein and attached thereto, each of said cylindrical pipes adapted to receive water therethrough;

a plurality of bullet tooth attachment blocks attached to the lower surface of each of said lobes, one bullet tooth attachment block being attached to the lower surface of each of said lobes adjacent said pilot bit and one bullet tooth attachment block attached to the lower surface of each of said lobes adjacent said outer end wall thereof;

a plurality of bullet teeth, each of said bullet teeth being removably attached within one of said attachment blocks, each of said bullet teeth having a hardened tip, each of said bullet teeth having a longitudinal axis that is at an angle to the plane of said lower surfaces of said lobes, the longitudinal axes of adjacent bullet teeth on each of said lobes being located substantially within the same plane and substantially parallel to each other, said pilot bit having a tip that is located below the hardened tips of said bullet teeth;

a tapered neck attached to an upper surface of said base plate and adapted to be connected to a drilling string;

said rotary claw bit having an axis of rotation about which it rotates in a counterclockwise or clockwise direction of rotation during use, said axis of rotation passing through the center of said base plate, said pilot bit and said tapered neck each having a longitudinal axis located on said axis of rotation;

said bullet tooth attachment blocks being positioned to hold said bullet teeth facing in the direction of rotation of said rotary claw bit during use.

13. The rotary claw bit of claim 12 wherein said first set of opposing lobes has two bullet tooth attachment blocks attached thereto, and said second set of opposing lobes has three bullet tooth attachment blocks attached thereto.

14. The rotary claw bit of claim 12 wherein said bullet tooth attachment blocks are adapted to hold the tips of said bullet teeth substantially the same height below said lower surfaces of said lobes.

15. The rotary claw bit of claim 12 wherein each of said first and second set of opposing lobes has inner bullet tooth attachment blocks attached thereto adjacent said pilot bit and outer bullet tooth attachment blocks adjacent the outer ends of said lobes, the height of said tips of said bullet teeth below said lower surfaces of said lobes to which said bullet teeth are removably attached within said inner bullet tooth attachment blocks being intermediate the height of said pilot bit and the height of said bullet teeth removably attached within said outer bullet tooth attachment blocks.

16. The rotary claw bit of claim 12 wherein said longitudinal axes of said bullet teeth are at an angle of about 45 degrees to the plane of said lower surface of said base plate.

* * * * *